US008801902B1

(12) United States Patent
Brown et al.

(10) Patent No.: US 8,801,902 B1
(45) Date of Patent: Aug. 12, 2014

(54) WATER REDUCTION BY MODULATING VACUUM

(71) Applicant: USG Interiors, LLC, Chicago, IL (US)

(72) Inventors: Martin W. Brown, Gurnee, IL (US); William A. Frank, Lake Villa, IL (US)

(73) Assignee: USG Interiors, LLC, Chicago, IL (US)

( * ) Notice: Subject to any disclaimer, the term of this patent is extended or adjusted under 35 U.S.C. 154(b) by 0 days.

(21) Appl. No.: 14/029,829

(22) Filed: Sep. 18, 2013

(51) Int. Cl.
*D21F 11/00* (2006.01)
*D21F 1/52* (2006.01)
*D21H 13/40* (2006.01)

(52) U.S. Cl.
CPC *D21F 11/00* (2013.01); *D21F 1/52* (2013.01); *D21H 13/40* (2013.01)
USPC ..... 162/217; 162/208

(58) Field of Classification Search
CPC ..... D21F 11/02; D21F 1/48; D21F 1/52; D21F 3/10; D21F 7/003; D21F 11/00; C04B 2111/52; D21H 13/40; D21J 1/20
USPC ..... 162/202, 208, 210, 217; 34/403, 406; 181/284, 290
See application file for complete search history.

(56) References Cited

U.S. PATENT DOCUMENTS 2,204,426 A * 6/1940 Millspaugh ..... 162/305
2,204,780 A * 6/1940 Thaler ..... 162/369
2,772,603 A * 12/1956 Waggoner ..... 162/145
3,005,490 A * 10/1961 Justus ..... 162/252
3,149,027 A * 9/1964 Mih ..... 162/208
3,839,521 A * 10/1974 Robinson ..... 264/87
3,846,233 A * 11/1974 Kankaanpaa ..... 162/312
4,440,597 A * 4/1984 Wells et al. ..... 162/111
4,466,873 A * 8/1984 Bolton et al. ..... 162/198
5,047,120 A 9/1991 Izard et al.
5,250,153 A * 10/1993 Izard et al. ..... 162/152
5,389,207 A * 2/1995 Rodriguez et al. ..... 162/363
5,974,691 A * 11/1999 Marchal et al. ..... 34/456
6,085,437 A * 7/2000 Stipp ..... 34/115
6,308,436 B1 * 10/2001 Stipp ..... 34/422
6,393,719 B1 * 5/2002 Stipp ..... 34/115
6,470,597 B1 * 10/2002 Stipp ..... 34/422
6,694,639 B2 * 2/2004 Hanaya ..... 34/115
7,862,687 B2 * 1/2011 Englert et al. ..... 162/152
8,383,233 B2 * 2/2013 Palm et al. ..... 428/220
2003/0019125 A1 * 1/2003 Hanaya ..... 34/114
2008/0073808 A1 * 3/2008 Miller ..... 264/86
2009/0126886 A1 * 5/2009 Englert et al. ..... 162/151
2011/0180225 A1 * 7/2011 Cao et al. ..... 162/145
2012/0164422 A1 * 6/2012 Palm et al. ..... 428/220

FOREIGN PATENT DOCUMENTS

EP 432571 A2 * 6/1991
WO WO 2009067300 A1 * 5/2009

* cited by examiner

*Primary Examiner* — Jose Fortuna
(74) *Attorney, Agent, or Firm* — Pearne & Gordon LLP

(57) ABSTRACT

A system and a method for dewatering an acoustical tile basemat comprising a continuously traveling wire, a device for depositing a dilute water slurry of solids including fiber and binder on the wire, a vacuum box below the wire for separating water from the solids deposited on the wire to form a basemat, a vacuum source, and a valve for cyclically connecting the vacuum source to the vacuum box at a cyclic rate that limits vacuum exposure to a length of the basemat newly arriving at the vacuum box to less than four inches per cycle.

5 Claims, 2 Drawing Sheets

WATER REDUCTION BY MODULATING VACUUM

BACKGROUND OF THE INVENTION

The invention relates to a method and apparatus for the manufacture of wet felted acoustical ceiling tile.

PRIOR ART

Acoustical ceiling tile is commonly made by a wet felting process on a Fourdrinier or Oliver mat forming machine. A dilute water slurry of mineral and/or other fibers, binder and other minor constituents is deposited on a travelling metal screen, known as a wire. Water is separated from the solids through the wire openings by gravity, the application of vacuum to the underside of the wire, and by pressing the solids with a roll or rolls situated above the wire some of which can be supplied with a vacuum.

Progressively higher vacuum level stations are used as the solids forming the mat progress along the path taken by the wire.

When as much water as practical has been removed by vacuum and, optionally, pressing, the mat is carried into a drying oven to remove excessive moisture and rigidify the mat for use in an acoustical tile.

By way of example, the slurry/mat can start with a thickness of 3 inches and be reduced to a thickness of ½ inch. The more water drawn from the mat prior to entry into a drying oven, the less energy is used in evaporating the excess moisture and the faster a production line can run.

Vacuum removal of water from the wire supported mat is limited by a tendency for the mat to crack along lines transverse to the wire movement. When a vacuum box operating at a high vacuum relative to the water content of the mat, excessive shrinkage can occur locally in the direction of wire travel. The result can be a transverse crack developed across the mat that renders it defective for use as a finished tile. This problem has existed for decades and attempts to solve it have had limited success. A commonly used technique is a slot or hole pattern at a vacuum box cover that applies suction to areas that depart from a plain transverse line so that cracking on such a natural line is less likely. Despite these efforts, cracking due to vacuum induced shrinkage has remained a limitation on line speed and, therefore, production capacity.

SUMMARY OF THE INVENTION

The invention involves the control of the application of dewatering vacuum in the production of a water felted mat for an acoustical tile. The control can modulate or pulsate the vacuum applied to the mat at a particular vacuum box or boxes so that the full vacuum level is applied in short time cycles. The effect of the modulated or pulsed vacuum is to avoid an abrupt application of suction over a relatively large area that otherwise would induce cracking of the mat through large scale shrinkage of the mat or cake due to evacuation of water.

The rate of vacuum modulation in relation to the conveying speed of the wire is high so that the mat is treated in small steps along the conveying length in a manner that may be compared to a jiggle or vibratory action. The modulated vacuum is less prone to produce cracking with the same vacuum level used in a traditional manner applied constantly to a vacuum box. The overall effect of the inventive process is the removal of more water from the mat prior in to entry in a dryer with the result of less time and energy expended in the dryer and a higher production rate.

As disclosed, the vacuum can be modulated by a constantly rotated valve that is ported to apply a cutoff vacuum to one or more vacuum boxes. The cycle of applied vacuum is determined by the rate of rotation of the valve.

DESCRIPTION OF THE PREFERRED EMBODIMENT

Figure 1:
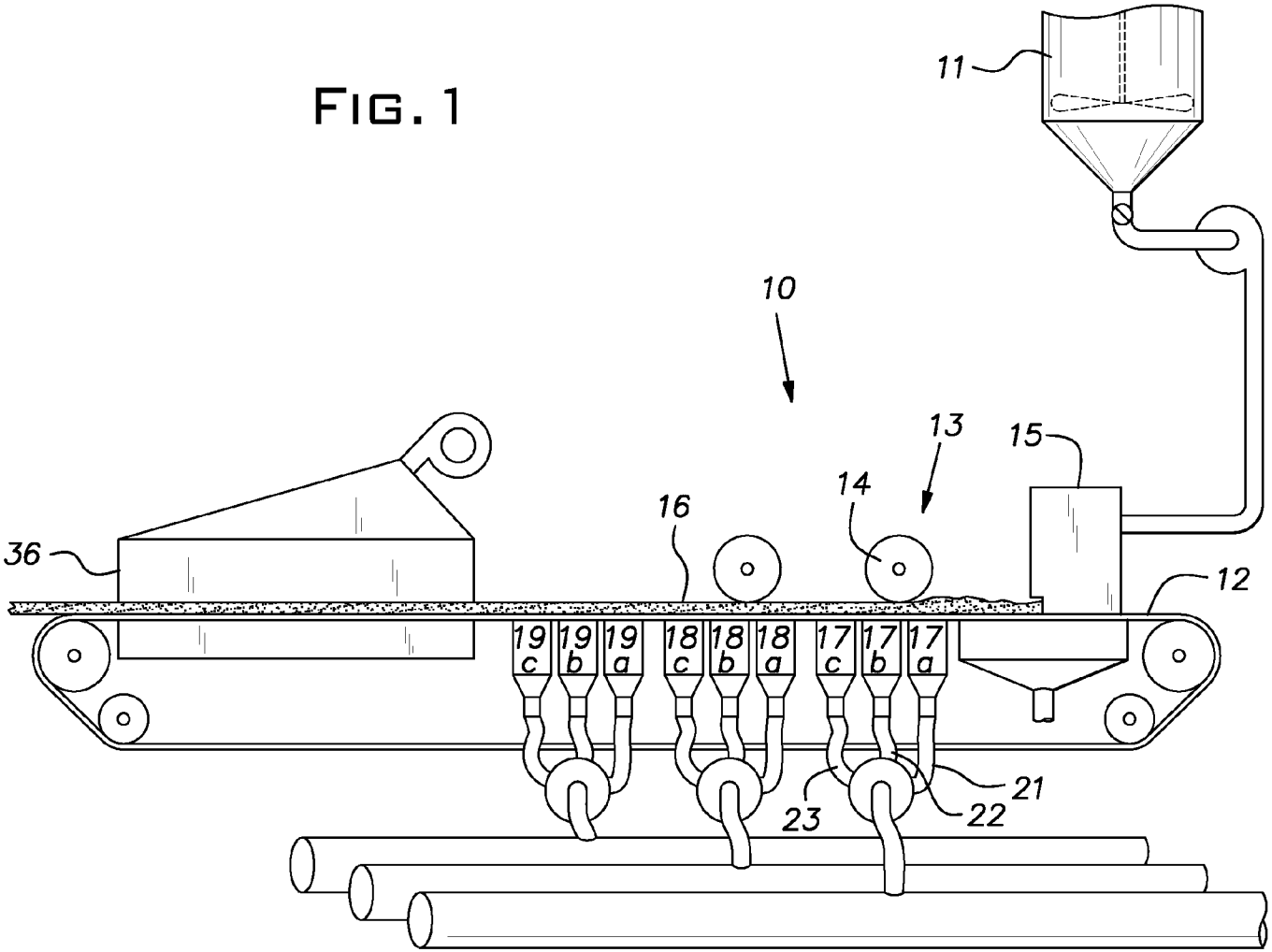
FIG. 1 is a diagrammatic representation of a water felting line for producing mats for acoustical tile in accordance with the invention.

With reference to FIG. 1, in a wet felting system 10, a dilute water slurry of mineral and/or other fiber, binder and minor quantities of other solid constituents are delivered from a mixing tank 11 to a travelling metal screen or wire 12 through a head box 15. Water, drawn by gravity, is removed from the constituents at a first section 13. The mass of solids is initially loosely distributed on the wire 12, for example, at a thickness of 3 inches. One or more rollers 14 may be employed to compact and unify the mat, designated 16, as it is being formed and conveyed by the wire 12 from right to left.

A plurality of vacuum boxes 17, 18 and 19 are situated below the upper run of the wire 12. The number and position of the vacuum boxes can vary depending on the design of the system 10. The system 10 may have, for example, three vacuum levels developed by three separate vacuum pumps. The vacuum levels may be, by way of example, 2.5, 7 to 9 and 14 to 15 inches of mercury. One or more vacuum boxes may be assigned to each vacuum level; in the illustrated system 10, there are three vacuum boxes associated with each vacuum level. The vacuum boxes 17 upstream of the screen conveying direction are at a low vacuum level, the boxes 18 are at the intermediate vacuum level, and the downstream boxes 19 are at the high vacuum level. It should be understood that more or less levels of vacuum may be used and more or less boxes for each vacuum level may be provided. Vacuum is delivered to the sets of vacuum boxes 17-19 through large ducts 21, 22 and 23, respectively, that run parallel alongside the wire 12.

Vacuum is developed by large pumps, one for each vacuum level, that operate continuously when the system 10 is operated.

Figure 2:
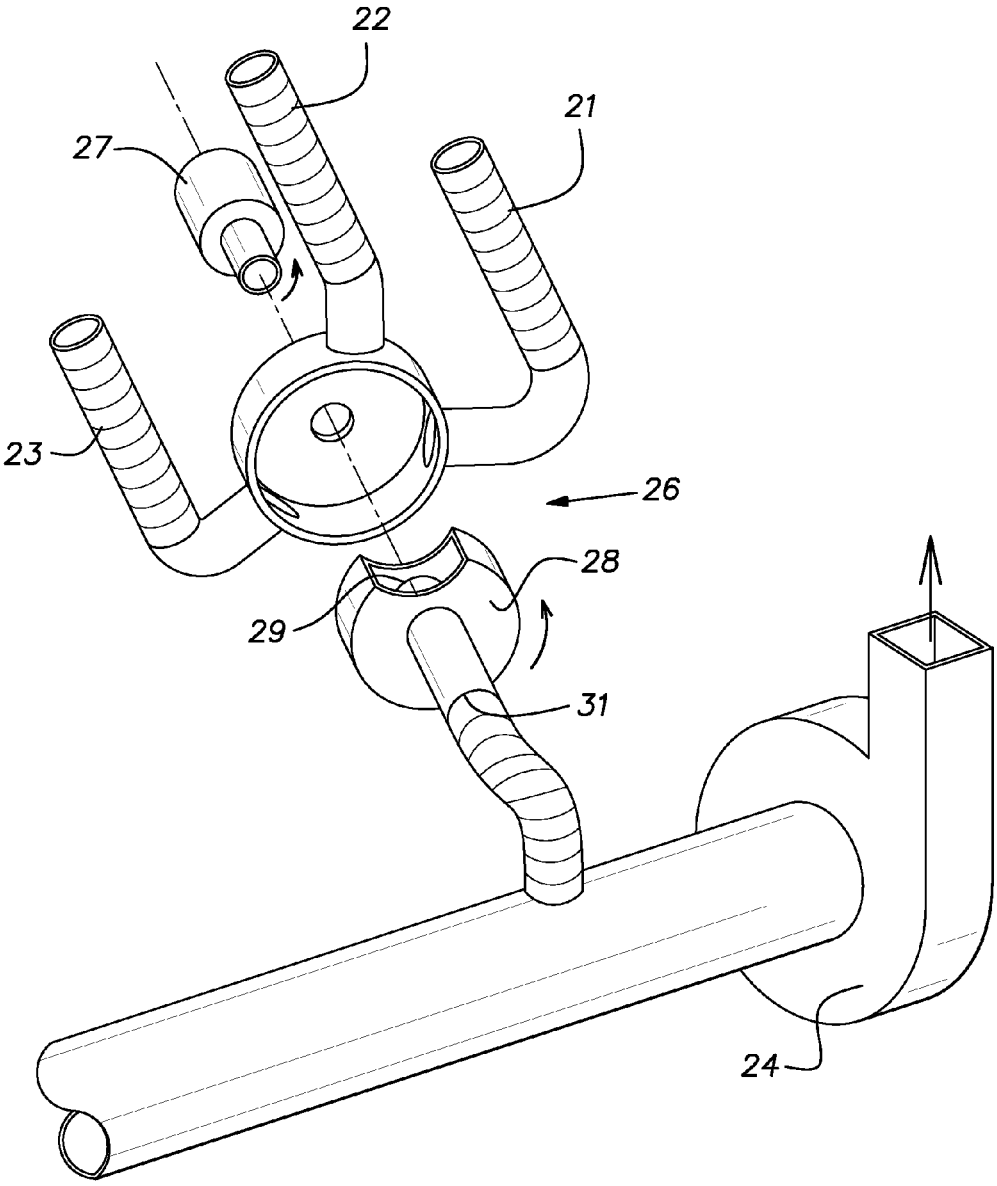
FIG. 2 is a diagrammatic exploded view of an exemplary vacuum control valve in association with a vacuum pump used in the mat production line of FIG. 1.

The invention contemplates rapid modulation of the vacuum applied to an individual vacuum box 17-19 to draw water from the mat while reducing the tendency of the mat to crack from water removal induced shrinkage. Vacuum is modulated by a separate valve 26 for each vacuum level diagrammatically represented in FIG. 2 inserted in a line between a duct 21-23 and respective vacuum boxes 17-19. Each duct 21-23 serves as both a manifold and, due to its volume, an accumulator of vacuum storage. A valve 26 operates cyclically by rotation developed by a motor 27 that preferably is speed adjustable. The illustrated valve 26 has three inlet ports, one for each vacuum box 17*a, b, c*, or 18*a, b, c*, or 19*a, b, c* with which it is associated. An outlet of a valve 26 is connected to one of the vacuum ducts 21-23. The valve 26 shown in FIG. 2 is connected to a low level duct 21 and three corresponding vacuum boxes 17*a*, 17*b* and 17*c* arranged in a series along the wire 12. A rotatable valve element 28 within the valve 26 successively connects and disconnects an inlet port 29 and an outlet port to the vacuum source or pump 24 through a duct.

A typical line speed of the wire 12 can range, for example, between 24 and 32 feet per minute. The valve can be rotated at, for example, between 60 and 120 rpm. This means that the valve element 28 will pulse or modulate 1 to 2 times per second, and the mat 16 will move between 4.8 and 6.4 inches in one second. It is envisioned that the valve 26 will have at least one inlet port 29 that will be open not more than 50 percent of a revolution. It can be shown that at 32 feet per minute, the mat is moving at 6.4 inches per second; if the valve is rotating at 60 rpm and open 50 percent of the time, the mat will move 3.2 inches while the valve applies vacuum to an advancing length of the mat. Based on geometrical considerations and general observations, application of a vacuum to an area of the mat corresponding to this incremental advance could be considered optimal for avoiding cracking due to excessive local shrinkage. That is to say, this advance of the mat under the vacuum at a box being influenced for the first time at that box, would not appear to result in excessive shrinkage. Where the wire 12 is running at less than 32 feet per minute and/or the valve had more than one inlet port open for its respective fraction of a revolution and/or the valve rotated at a rate higher than 60 rpm, the mat would advance a proportionately shorter distance than 3.2 inches. More specifically, it can be been that these factors of wire speed, port number, and valve rotational speed each have a multiplier effect. Thus, the valve 26 can influence a much shorter increment of advancing mat and thereby reduce the effect of any shrinkage produced by the vacuum across the increment of advancing web length. The result is that the mat can be subjected to a vacuum level of some conventional magnitude but the risk of shrinking the mat by water depletion through the degree that it cracks is greatly diminished.

Improved water removal reduces time and energy required in a dryer shown at 36. This can permit the production line to be operated at a higher speed and acoustical tiles to be produced at lower cost.

The same vacuum modulating valve 26 may be employed, as shown at the other sets of vacuum boxes 18 and 19. It is conventional that the downstream vacuum boxes 18, 19 are operated at higher vacuum levels than the preceding vacuum boxes 17, 18.

The valve 26 diagrammatically illustrated in FIG. 2 is but one of a variety of constructions that can be envisioned to practice the invention. For example, the valve 26 can have one or more inlet ports, multiple ports can be actuated at irregular times in a cycle, some ports can be open longer than others, and multiple ports can be open at the same time.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A method of dewatering a slurry of fiber and binder for use in making a basemat in a water felting process on a travelling wire comprising establishing a fiber and binder slurry on the travelling wire, subjecting the fiber and binder slurry to a vacuum applied to the bottom of the wire by cyclically modulating the vacuum in a vacuum box under the wire between a peak vacuum value and an atmospheric pressure.

2. A method as set forth in claim 1, wherein a cyclic rate of modulation of pressure is sufficient to limit an incremental length of a stream of the fiber and binder slurry on the wire initially exposed to the vacuum at the vacuum box to a length of less than 3.2 inches.

3. A method as set forth in claim 1, wherein the vacuum is modulated by a rotary valve driven by a motor.

4. A method as set forth in claim 3, wherein the motor is a variable speed unit.

5. A method as set forth in claim 3, wherein the valve has a plurality of inlet ports each serving a separate vacuum box disposed along the wire.

* * * * *